United States Patent [19]

Glucksman

[11] Patent Number: 5,014,338

[45] Date of Patent: May 7, 1991

[54] PORTABLE AIR HUMIDIFIER

[76] Inventor: Dov Z. Glucksman, 137 Larch Row, Wenham, Mass. 01984

[21] Appl. No.: 287,330

[22] Filed: Dec. 21, 1988

[51] Int. Cl.[5] ..... F24F 3/14

[52] U.S. Cl. ..... 392/405; 200/81.9 R; 392/406

[58] Field of Search ..... 219/271, 272, 273, 275, 219/276, 362; 200/81.9 R; 392/402, 403, 405, 406

[56] References Cited

U.S. PATENT DOCUMENTS

| | | | |
|---|---|---|---|
| 1,361,028 | 12/1920 | Drake | 392/405 |
| 1,749,969 | 3/1930 | Brodin | 392/406 |
| 1,756,053 | 4/1930 | Colton | 392/405 |
| 2,062,613 | 12/1936 | Schleimer | 392/405 |
| 2,211,407 | 8/1940 | Christensen | 392/405 |
| 3,201,772 | 8/1965 | Ladusaw | 200/81.9 R |
| 3,366,775 | 1/1968 | Mycue | 219/272 |
| 3,418,068 | 12/1968 | Gilbertson | 219/276 |
| 3,670,141 | 6/1972 | Dines | 219/271 |
| 3,743,780 | 7/1973 | Camp | 219/275 |
| 4,137,574 | 2/1979 | Collins | 219/273 |
| 4,274,588 | 6/1981 | Schwob | 219/273 |
| 4,725,700 | 2/1988 | Zoludow | 200/81.9 R |
| 4,810,854 | 3/1989 | Jursich et al. | 219/276 |

FOREIGN PATENT DOCUMENTS

| | | | |
|---|---|---|---|
| 108453 | 8/1979 | Japan | 219/271 |

*Primary Examiner*—Geoffrey S. Evans

*Attorney, Agent, or Firm*—Leydig, Voit & Mayer

[57] ABSTRACT

The components of an electric warm-air humidifier are enclosed in a housing. The components include an evaporation chamber in the shape of an inverted cup which has a steam outlet in its top and contains an electric heating element positioned at a short distance above its open bottom. The chamber bottom and the heating elements are immersed in water contained in the main compartment of an open, removable tray, having a smaller filling compartment communicating with the main compartment. The tray may be removed from the housing for cleaning. The neck of an inverted, removable jug filled with water is placed into the filling compartment, and water fills the tray until its level reaches the lower rim of the jug's neck. A blower is mounted above the evaporation chamber and delivers cool air through a duct which communicates with the evaporation chamber via its steam outlet, and humidified air is blown back into the room. The humidifier also contains a control element to prevent damage to the heating element and signal lamps warning an attendant to refill the jug with water. The humidifier may also include a removable drawer.

13 Claims, 3 Drawing Sheets

PORTABLE AIR HUMIDIFIER

BACKGROUND OF THE INVENTION

The invention relates to a portable, electric air humidifier, more particularly to an improved warm-air humidifier.

Air humidifiers have been found to be important in controlling the environment in homes during very dry weather, or in winter whenever outside air of low temperature is drawn inside and heated, causing the relative humidity in the home to be lowered to an uncomfortable degree.

Portable humidifiers are well known in the art, and may be classified as follows:

1. Steam generators which comprise a water container and an electric heating element submerged in the water, there being provided safety devices for switching off the current as soon as the water level drops below the heating element. A flow of hot steam is blown directly into the room to be humidified and there is always the danger of a person, especially a child, being scalded whenever he comes into contact with the jet of steam ejected at a temperature of 212° F. Furthermore, the container of hot water, when overturned, may cause serious injuries to the person nearby.

2. Porous medium humidifiers generally include a porous medium structure partly submerged in cold water contained in an open vessel and a blower unit drawing air through the porous medium structure. The porous medium is either in the shape of a disc or a drum with part of the medium dipping into the water, which is slowly rotated while air is blown through the portion above the water level, thus carrying humidity into the room; or it is in the form of a stationary body adapted to draw water into the upper non-immersed part by capillary action, from where it is carried into the room by air blown therethrough.

3. Ultra-sonic humidifiers generally comprise a container filled with water which is brought to vibration by high-frequency vibrator means which causes the water to be atomized. An air stream directed onto the water surface carries the mist into the room to be humidified.

The major drawback of both the two latter appliances is the fact that the water staying in the container is not heated to boiling point as in the steam generator and, therefore, is susceptible to the growth of microorganisms which are subsequently carried by the air stream into the room and ingested by the people staying there.

4. Warm-air humidifiers share the benefits of steam generators in that growth of micro-organisms is forestalled by heating the water to boiling point. Also, warm-air humidifiers avoid the drawback of hot steam entering the room, since in this type of humidifier the steam is carried into the room as a mist mixed with air, at a temperature to be selected by judiciously choosing the ratio of steam and air.

A typical warm-air humidifier is described in U.S. Pat. No. 4,564,746: it includes a heated evaporation chamber which is enclosed to prevent leakage or damage, and a fan adapted for dispersing the generated steam into the room via a cabinet passageway. The evaporation chamber is mounted on tracks which permit its sliding out of its enclosure and is thus easily accessible for cleaning and servicing. The heating element which is operationally enclosed in the chamber is attached to a cover which is likewise movable out of the humidifier cabinet for cleaning and servicing.

The drawback of this humidifier is its relatively intricate and expensive design: according to the description, the heating element is attached to a movable cover which is provided with flexible tubing and must be moved upwards on vertical tracks in order to clear the top of the water enclosure, permitting the latter to be slid out sideways. It requires a significant amount of space and cannot be serviced except by a skilled person.

It is, therefore, one object of the present invention to avoid the aforementioned drawbacks and to provide a portable room humidifier of simple design permitting its handling by any person having only a limited technical knowledge.

It is another object to provide a compact, portable appliance requiring a minimum of space, even while being opened for servicing and cleaning.

It is a further object to provide a humidifier which will operate at a moment's notice owing to a very small volume of water to be heated and brought to boiling point during the time it is in operation.

And it is still another object to provide a humidifier at low cost allowing its purchase and use by a majority of families.

These and other objects will be readily apparent from the following description of the invention and claims.

SUMMARY OF THE INVENTION

The portable, warm-air humidifier according to the present invention is characterized by its instantaneous starting of operation owing to a very small volume of water contained in an evaporation chamber in which an electric heating element is immersed. The humidifier includes an evaporation chamber in the shaped of an inverted cup which is provided with a steam escape port in its top portion and contains an electric resistance heater close to its open bottom end. The open bottom end is immersed in water contained in an open tray which is kept filled with water to a predetermined level from a portable jug positioned above a portion of the tray in upside-down state, allowing water to flow into the tray only as high as the lower rim of the neck of the jug. The tray may be positioned in a V-shaped trough formed by a portion of the appliance housing and a portion of a horizontally movable drawer. Withdrawal of the drawer widens the trough and causes the tray to be lowered so as to clear the bottom of the evaporation chamber and to be pulled out of the appliance for cleaning purposes another embodiment of the warm-air humidifier includes a try, access to which occurs by opening a hinged portion of the humidifier. A centrifugal blowing is mounted above the evaporation chamber and serves to draw in air from the room, drawing the air across the evaporation chamber, and then blow it back into the room in saturated state. In greater detail, the air passes through a duct extending above the steam escape port of the evaporation chamber which causes mixing of the steam with the cool air passing across the port.

Additional features may include a thermostatic switch interrupting the current supply to the heating element as soon as the water level in the tray drops below its immersion level, and a signal lamp which lights up at the same time, indicating lack of water in the jug.

Still another feature is an air filter mounted upstream of the blower and a signal lamp which indicates a clogged filter by measuring excessive resistance to the air flow, thereby indicating the need to clean or to change the filter.

The neck of the jug is preferably closed by a spring-supported valve which prevents water from flowing out while the jug is held in upside-down state and is opened by a pin in the tray, as soon as the jug is placed into its correct position above the tray.

DETAILED DESCRIPTION OF THE DRAWINGS

Figure 3:
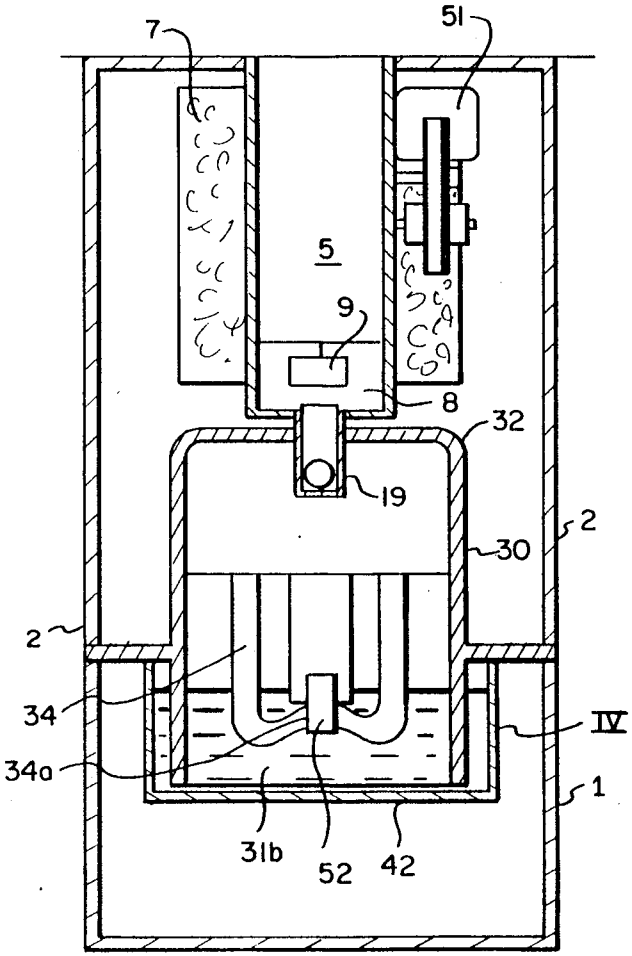
FIG. 3 is a section through the warm-air humidifier along line A—A of FIG. 1.
Figure 1:
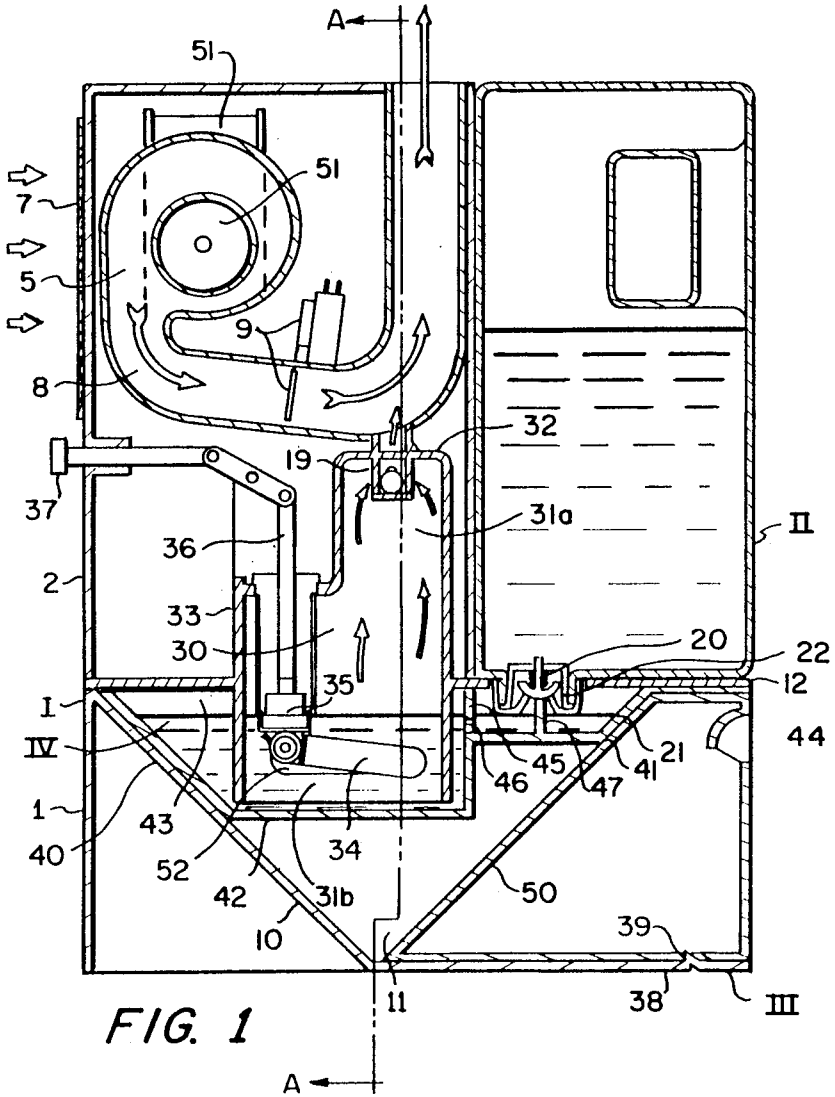
FIG. 1 is a vertical section through the warm-air humidifier of the invention and through an inverted water container in position on the tray of the humidifier.
Figure 2:
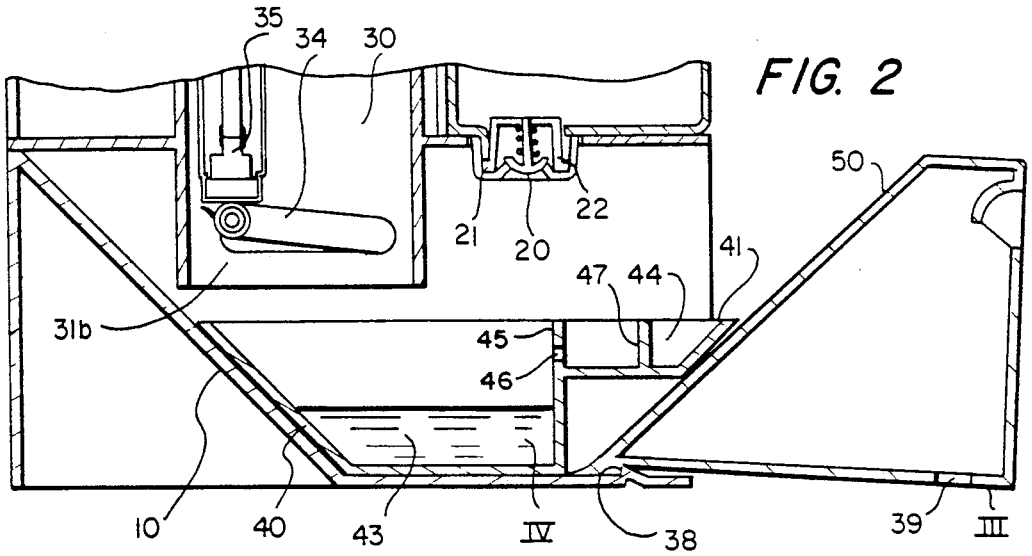
FIG. 2 is a vertical section through the bottom portion of the humidifier illustrated in FIG. 1, showing the tray in lowered position ready for removal.

The components of the warm-air humidifier as shown in FIGS. 1 and 2 are enclosed in an L-shaped housing I including a base portion 1 and a top portion 2, the base being configured to support a water jug II in upside-down position. The base contains a drawer III of trapezoidal cross section which forms together with a sloping inner wall 10 of the base, a V-shaped trough 11. A tray IV is supported by the respective sloping walls 10 (of the housing) and 50 (of the drawer), whereby the contours of two opposite side walls 40 and 41 of the tray correspond in slope to the inclination of the two walls, while the tray bottom 42 is substantially flat. The tray includes a main compartment 43 and a filling compartment 44, in proximity to the drawer wall 50, which are separated by a partition 45 perforated by a connecting port 46. A vertical pin 47 projects from the bottom of the filling compartment and connects with a spring-supported valve 20 in the neck opening 22 of the inverted jug II.

The top portion 2 includes an evaporation chamber 30 in the shape of an inverted cup which extends into the base portion 1 and into the main compartment of the tray, stopping short of the flat bottom 42 with a narrow gap remaining between the lower rim of the chamber and the bottom. The chamber top is stepped, forming a higher portion 31*a* which contains a steam port 32, and a lower portion 31*b* into which a flask-shaped member 33 is inserted and hermetically closed to prevent steam from escaping therethrough. Member 33 holds a thermostatic switch 35, as well as a set of levers 36 serving for resetting the switch by means of a knob 37. The tray, as well as the bottom of the evaporation chamber is filled with water, its upper level being defined by the lower rim 21 of the valve 20 in the neck of the jug II. An electric heater 34 is fully immersed in the water, and is held at its raised portion 34*a* in intimate contact with the member 33 by means of a spring clip 52. The heater is switched off as soon as the water level drops below the raised portion 34*a* of the heating element due to lack of water in the jug.

The top portion of the housing contains a centrifugal blower 5 driven by an electric motor 51. It sucks outside air through a removable air filter 7 attached to the housing outside. Air is blown into the room to be humidified by means of an angular delivery duct 8, which terminates at the top of the housing and passes closely along the top of the evaporation chamber, where it communicates with the steam port 32. The delivery duct contains a sail-switch 9 serving to operate a warning light. As soon as the filter 7 is clogged, i.e., as soon as the air flow is not sufficiently strong to push the sail switch, the warning light goes on.

Figure 4:
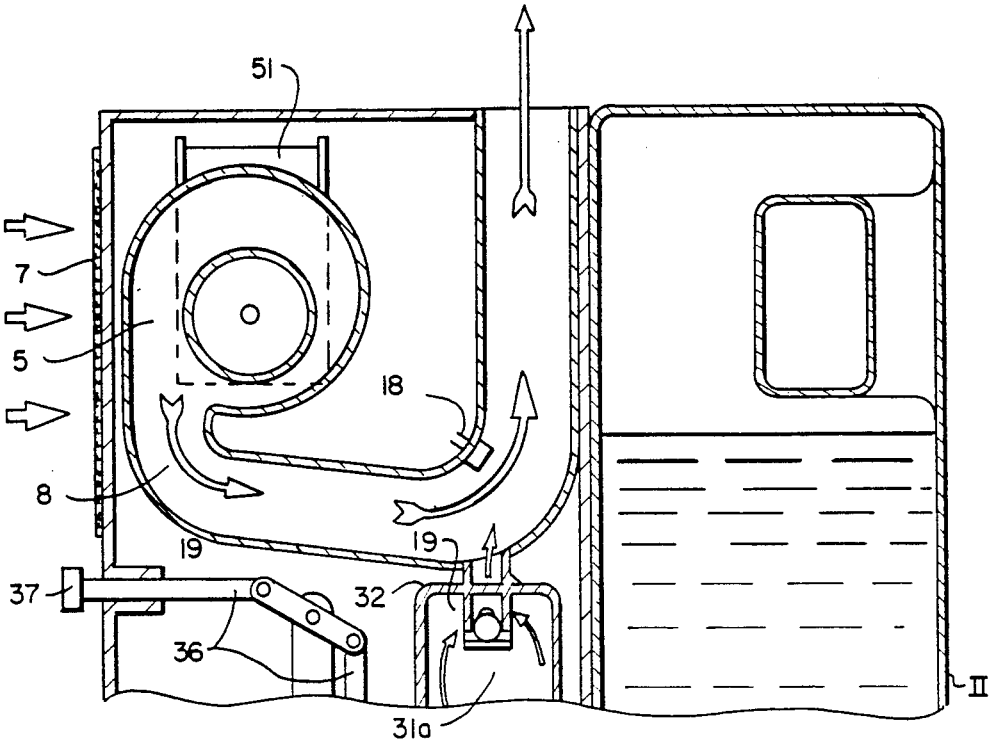
FIG. 4 is a vertical section through the top portion of the humidifier illustrated in FIG. 1, showing a thermostat in the air flow duct.

An alternate way to turn on the warning light is shown in FIG. 4 where a thermostat 18 is placed in the air duct 8 beyond the point where air and steam mix. If, due to a clogged filter, the air to steam ratio decreases, the thermostat will sense a higher temperature and will switch on the warning light.

The port 32 at the top of the evaporation chamber is downwardly surrounded by a ball valve assembly 19, causing the ball to close the port whenever the appliance is turned on its side, thus preventing hot water from flowing out of the chamber.

Another warning device is in the form of a second light, (not shown in the drawing) which is actuated as soon as the thermostat 35 interrupts current supply to the heating element 34, issuing a signal that the tray is empty and that a jug full of water needs to be placed onto the filling compartment 44.

For operation of the humidifier, the jug II, full of water, is placed with its valve 22 onto the filling compartment whereupon the pin 47 urges the valve body 20 upwards off its seat and permits water to flow into the tray. Water flows out of the filling compartment into the main compartment through the port 46 in the partition 45, the level being defined by the rim 21 of the jug's neck; for the reason that no air can flow into the jug through the neck as soon as it is covered by water and, obviously no water can flow out. Both the blower 5 and the heating element 34 are energized, the steam created in the evaporation chamber mixes with the air delivered by the blower and is blown into the room as a mist. Due to evaporation, the water level in the tray will drop below the height of the rim of the jug, permitting more water to enter the tray and keeping it filled to the predetermined level. For the purpose of cleaning the tray, the drawer III is pulled out of the housing, causing the tray to slide down along the inclined wall 10 of the housing as shown in FIG. 2 of the drawing. At the same time, the pin 47 in the filling compartment is taken out of contact with the valve 20 of the jug, thereby closing the neck opening and preventing water from flowing out into the tray. The drawer III can now be withdrawn from the housing and the tray IV can be taken out. In order to keep the drawer in position inside the housing a tongue 38 projects upwardly from the bottom of the housing and engages an opening 39 in the bottom of the drawer when this is in closed position.

It will be understood that the humidifier described in the foregoing with reference to the accompanying drawings represents only one embodiment of the invention, and that variations and modifications may be carried out by a person skilled in the art, within the scope of the appended claims.

Figure 6:
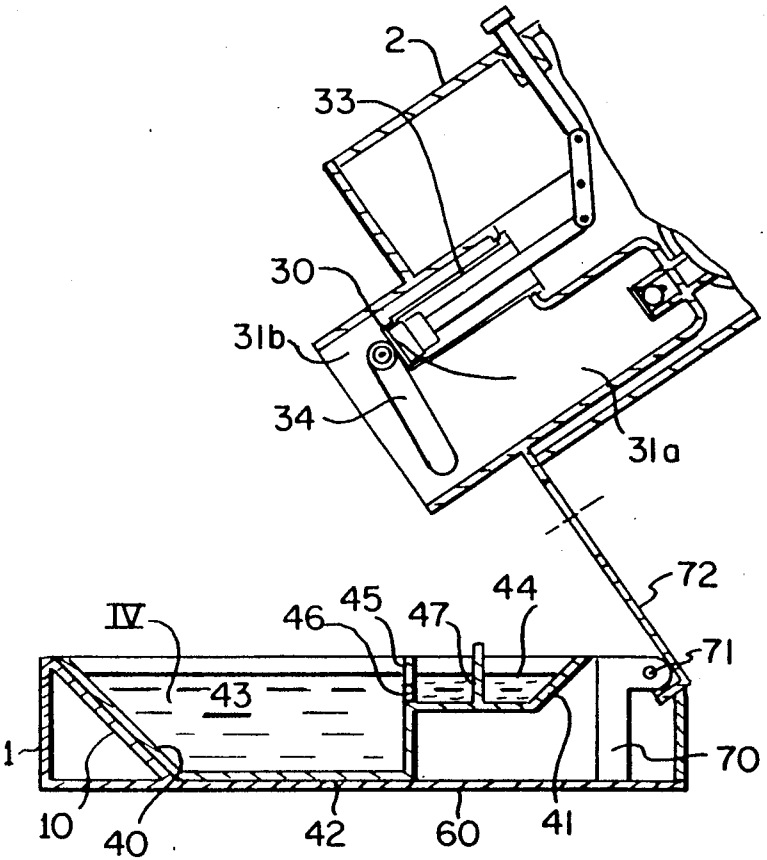
FIG. 6 is a vertical section of the warm-air humidifier containing a hinged base, shown in its open position.
Figure 5:
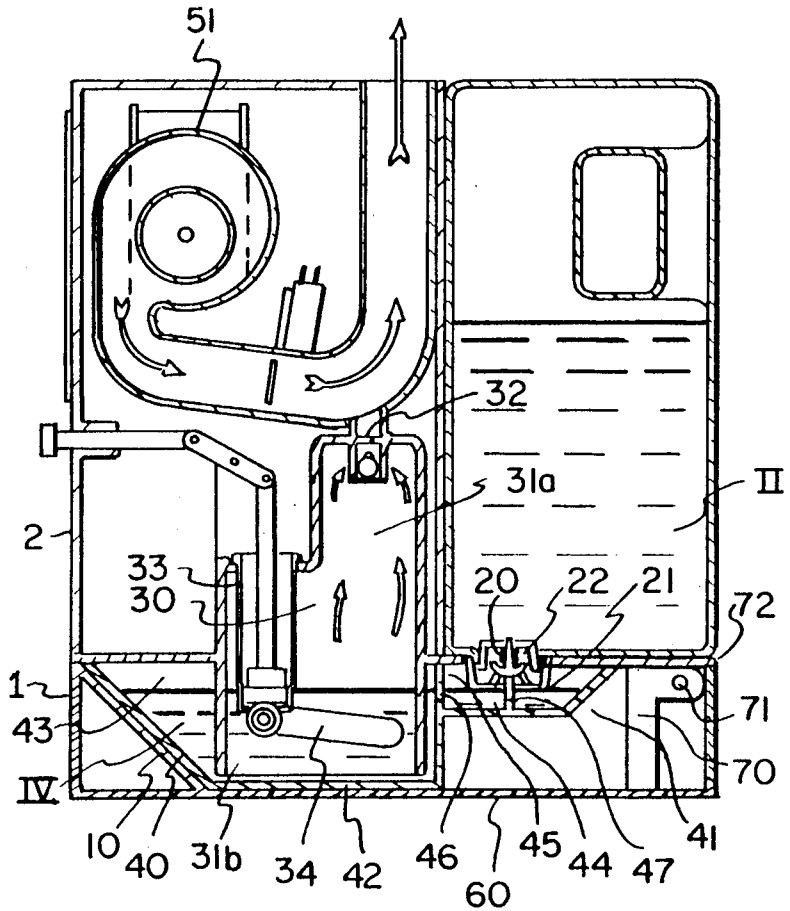
FIG. 5 is a vertical section of the warm-air humidifier containing a hinged base, shown in its closed position.

FIGS. 5 and 6 show another embodiment of the present invention. In this warm-air humidifier, top portion 2 is hinged, allowing easy access to the tray IV. In FIG. 5, illustrating the closed position, the lower portion 31*b* of evaporation chamber 30 is surrounded by the tray IV area. A hinge assembly, comprising a hinge 71 and a hinge support member 70, are attached to the jug support platform 72, allowing the top portion 2 of the L-shaped housing I to be moved to an open position, as shown in FIG. 6. These figures also show an embodiment of the invention which does not include a drawer. In this embodiment, base 60 supports the tray bottom 42. When the top portion 2 is moved to its open position, the tray IV is exposed, allowing its easy removal.

While particular embodiments of the invention have been described, it will be understood that the invention is not limited thereto, and that many obvious modifications and variations thereof can be made, and that such modifications are intended to fall within the scope of the appended claims.

I claim:

1. A portable, warm-air humidifier comprising:

a housing, containing the components of said humidifier consisting of a base and a top portion, said base protruding beyond one side of said top portion;

an evaporation chamber containing a steam-escape port and heater;

an open tray comprising a main compartment of larger horizontal dimensions than said evaporation chamber and accommodating the bottom portion of said evaporation chamber, and a filling compartment communicating with said main compartment, said filling compartment serving to accommodate the neck of an inverted jug and positioned over the protruding base portion so that water flows out of said jug into said filling compartment to a height defined by the lower rim of said neck;

a removable drawer positioned in said base of said housing and having a sloping wall opposite a sloping wall of said housing, said two walls forming a V-shaped trough supporting said open tray by its side walls which are inclined similarly to said sloping walls;

a motor-driven blower positioned in said housing; and a duct, communicating with said steam escape port of said evaporation chamber and with said blower.

2. The warm-air humidifier of claim 1 including an air filter positioned in the suction side of said blower.

3. The warm-air humidifier of claim 2 including an air flow sensor mounted in said duct for indicating clogging of said filter.

4. The warm air humidifier of claim 3 wherein said air flow sensor comprises a sail switch which energizes a signal lamp.

5. The warm air humidifier of claim 3 wherein said air flow sensor comprises a thermostat which energizes a signal lamp.

6. The warm-air humidifier of claim 1 wherein said jug is provided with a spring-supported valve in its neck portion, and wherein said filling compartment is provided with an upstanding pin serving to urge said valve inwardly of said jug and to open said valve permitting water to flow into said tray.

7. The warm-air humidifier of claim 1 including a thermostatic switch attached to said heater for interrupting current supply to said heater, and a reset mechanism for re-energizing said thermostatic switch and for supplying electric current to said heater.

8. The warm-air humidifier of claim 1 wherein said port contains a ball valve serving to close said steam escape port.

9. The warm-air humidifier of claim 1 wherein a partition is provided between said main compartment and said filling compartment of said tray, communication between said two compartments being effected through an opening in said partition.

10. The humidifier of claim 1 wherein said evaporation chamber is in the shape of an inverted cup.

11. The humidifier of claim 1 wherein removal of said drawer lowers said tray below the bottom of said evaporation chamber.

12. The warm air humidifier of claim 1 wherein water flows into said filling compartment as soon as the water level in said filling compartment is lower than the lower rim of said neck.

13. The warm air humidifier of claim 1 wherein said filling compartment is connected to said main compartment by a connecting port.

* * * * *